United States Patent [19]

Fisher

[11] 4,044,867

[45] Aug. 30, 1977

[54] INFLATABLE LUGGAGE

[76] Inventor: Robert J. Fisher, 170 City Blvd. West, Apt. 201, Orange, Calif. 92668

[21] Appl. No.: 692,444

[22] Filed: June 3, 1976

[51] Int. Cl.[2] ..... A45C 7/00

[52] U.S. Cl. ..... 190/43; 150/.5; 206/522

[58] Field of Search ..... 190/42, 43, 44; 150/.5, 150/1; 206/522; 4/172, 177

[56] References Cited

U.S. PATENT DOCUMENTS

| | | | |
|---|---|---|---|
| 918,391 | 4/1909 | Taarud | 206/522 X |
| 3,058,122 | 10/1962 | McDaniel | 4/177 |
| 3,587,794 | 6/1971 | Mattel | 190/43 |
| 3,619,825 | 11/1971 | Taub | 206/522 X |
| 3,631,544 | 1/1972 | Tytel | 206/522 X |
| 3,891,082 | 6/1975 | Fall | 190/43 X |

*Primary Examiner*—Donald F. Norton
*Attorney, Agent, or Firm*—Warren F. B. Lindsley

[57] ABSTRACT

Inflatable luggage that may be designed, fabricated and produced in any geometric shape or form utilizing heat sealable flexible material having side, top, bottom and end walls at least some of which have communicating air chambers and passages for providing an inflatable semi-rigid enclosure. When deflated, the luggage may be flattened, rolled up and stored in a suitable, easily handled container. The inflatable luggage piece may be provided with either a separate or integrated source of air under pressure for inflating and deflating its chambers and passages to expand the luggage to its full luggage carrying size.

6 Claims, 21 Drawing Figures

INFLATABLE LUGGAGE

BACKGROUND OF THE INVENTION

This invention relates to inflatable and deflatable luggage that is semi-rigid in its inflated form and collapsible in its deflated form for convenient storage.

1. Field of the Invention

This invention is particularly directed to lightweight, sturdy, inexpensive pieces of luggage of most any size, shape or form, that are preferrably fabricated of flexible, heat sealable material which is impervious to the passage of air or moisture. Vinyl, polyethylene or other plastic coated or impregnated material together with rubberized materials are suitable for such luggage. Selected walls and in some embodiments the cover pieces of such luggage are provided with communicating air chambers and passages which when inflated are adapted to support and maintain the walls and cover piece in semi-rigid, expanded relationship as determined by the configuration of the luggage piece. When deflated, the air chamber and passageways collapse and may be folded flat or rolled into a compact package for storing in a suitable container.

2. Description of the Prior Art

Heretofore several types of inflatable luggage have been devised for carrying personal items such as clothing, business papers and other paraphernalia.

These prior art inflatable luggage pieces utilized air chambers located in certain walls of the structure and rigid sheet material in other wallsk such as their bottom, top or cover portions to provide the necessary rigidity required. The rigid sheet material, however, hindered total collapse of the luggage piece when its air chambers were deflated and restricted its capability of being rolled up or folded into a relatively small compact package for storage.

The air-chambers of such luggage pieces were inflated with a supply of pressurized air through a suitably built-in valve means. In most instances, sufficient air to inflate the air chambers had to be forced in with separate pump means to obtain the desired inflation. In addition, a source of air under pressure separate from the luggage was needed each time the luggage was inflated.

SUMMARY OF THE INVENTION

It is, therefore, an object of this invention to provide improved forms of inflatable luggage that are sturdy, light in weight, inexpensive to manufacture and readily collapsible for convenient storage.

Another object of this invention is to provide improved forms of inflatable luggage which when deflated and collapsed have the capability of being rolled up or folded into a compact package and conveniently stored in a suitable container.

A further object of this invention is to provide improved forms of inflatable luggage having air chambers in at least some of its structural walls, bottom and cover, the arcuate sides of said chambers projecting into the interior and out from the exterior of the luggage piece to provide insulative, protective and reinforcing buffer means for the contents and structural walls of the luggage.

A still further object of this invention is to provide improved forms of inflatable, collapsible luggage wherein the walls of the inflatable passageways are formed of material of different thickness or resiliency which deflect differently when the passageways are inflated to form various cross sectional configurations.

A still further object of this invention is to provide improved forms of inflatable, collapsible luggage having communicating air chambers and passages in at least some if not all of their structural walls, bottom and cover portions which are inflatable with air under pressure derived from either a separate or integrated source.

A still further object of this invention is to provide new and improved inflatable luggage in which the inflatable source of air under pressure is built into the luggage piece.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Referring more particularly to the drawings by characters of reference, FIGS. 1, 8, 9, 15 and 17 disclose different forms of inflatable luggage embodying features of this invention. Since FIGS. 1 through 7 of the drawings clearly illustrate most of the features of the invention which apply to most forms of inflatable luggage, a detailed description of the suitcase or briefcase form shown in FIG. 1 should suffice to disclose the major features of this invention.

Figure 1:
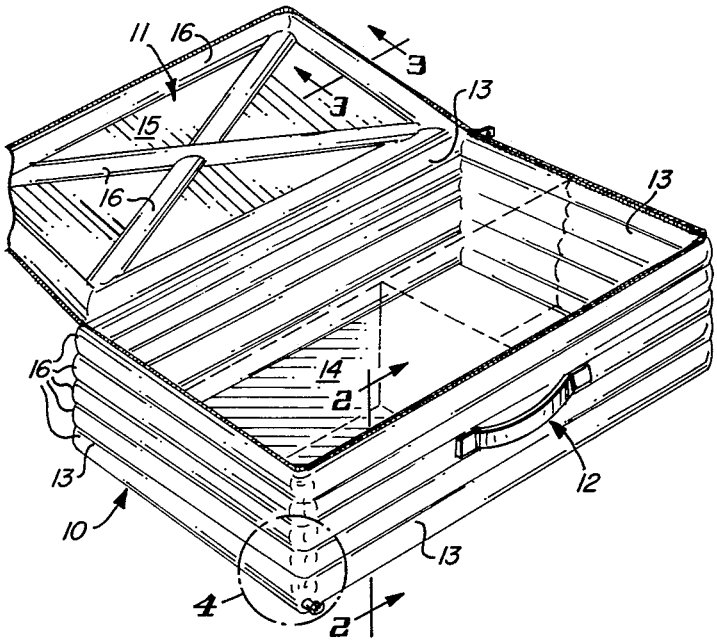
FIG. 1 is a perspective view of an inflatable luggage piece in the rectangular form of a suitcase, briefcase or the like incorporating the features of the invention.

The suitcase or briefcase form of inflatable luggage shown in FIG. 1 in its inflated condition comprises a box-like rectangular enclosure 10 having a hinged cover 11 and carrying handle 12. The vertically disposed side walls 13, horizontally disposed bottom panel 14 and hinged cover panel 15 are preferrably fabricated of two layers or plies of heat sealable, flexible material that is impervious to the passage of air or moisture. This material may be, for example, vinyl, polyethylene or other suitable plastic material, rubber coated or impregnated fabric having the desired air impervious characteristics.

The side walls 13, bottom panel 14 and cover panel 15 are all provided with air chambers and communicating passages that are adapted to be inflated in their entirety with air under pressure derived from a suitable source. These chambers provide the added strength and rigidity to all the structural elements of the luggage in its inflated form and provide for total collapse of the same in its deflated form.

Figure 2:
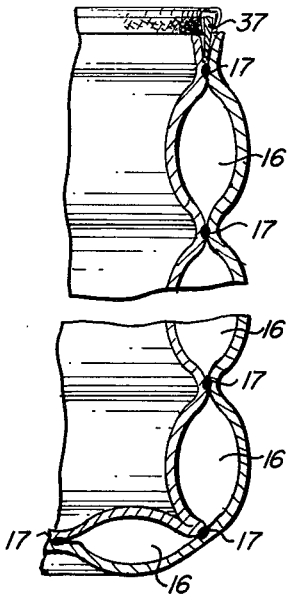
FIG. 2 is a fragmentary vertical cross-sectional view taken on the line 2—2 of FIG. 1 though one of the structural walls of the luggage piece illustrating one method of forming air chambers therein and securing one element of a slide-fastener at its top edge.
Figure 3:
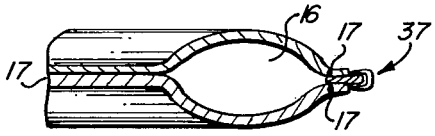
FIG. 3 is a fragmentary cross-sectional view taken on the line 3—3 of FIG. 1 through the outer edge of the hinged cover of the luggage piece illustrating one method of forming an air chamber around its periphery and securing one element of a slide-fastener at its outer edge.
Figure 4:
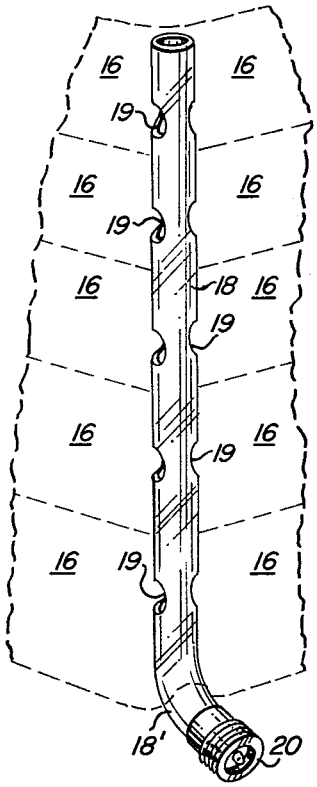
FIG. 4 is a fragmentary elevational view indicated by the circle "4" in FIG. 1, showing a right angled corner of a luggage piece and illustrating one method of utilizing vertically disposed, flexible, tubular corner pieces having apertures that communicated with the air chambers.

The plurality of communicating air chambers, passageways or passages 16 formed in the side walls 13, bottom panel 14 and cover panel 15 between the double plies of material are formed by heat sealing as indicated at 17 in FIGS. 2 and 3 of the drawings to provide airtight conduits or passages when inflated. The air passages 16 are adapted to communicate with identical air chambers formed in associated bottom and cover structural walls of the luggage at their connecting edges and corners by suitable passages (not shown) or by slightly less flexible, vertically or horizontally disposed conduits 18, such as shown in FIG. 4 of the drawings. Conduits 18 are provided with apertures 19 which are adapted to communicate with the air passages 16 to thus provide a continuous circulation of the air through the interconnected air chambers, passages and associated conduits, the communicating association of which, tends to increase the strength and rigidity of the structural elements of the luggage piece when in its inflated condition.

Referring especially to FIGS. 2 and 3 of the drawing, it should be noted that when the air passages 16 are inflated they assume a cross-sectional configuration that may be circular, elliptical or any other shape determined by the expansion of the plies of material between which they are formed so as to provide a plurality of inwardly and outwardly projecting, convex surfaces that function as protective and insulative shock absorbers or buffers for the contents of the case and the outside surfaces of its structural walls. As shown in FIGS. 2 and 3 the elliptical cross-sectional configurations of the passageways are at least partly due to unequal strength of the plies of materials and the means of interconnecting adjacent passageways.

Figure 6:
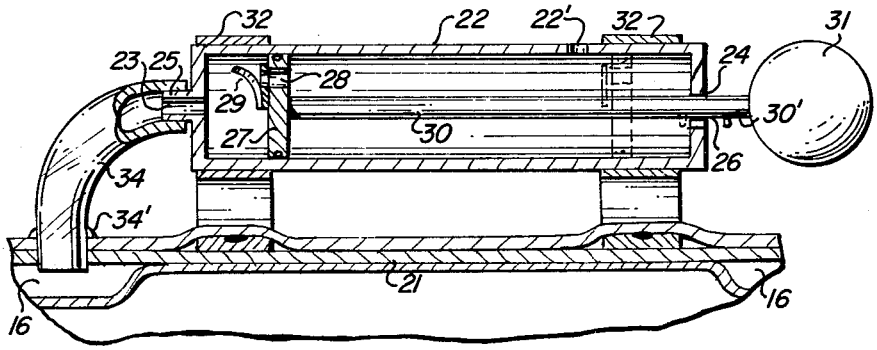
FIG. 6 is a cross-sectional view of FIG. 5 taken along the line 6—6 showing the interior components of the handle air supply source and its installed relationship with the structural wall and an air chamber formed therein.

The upper edges of the vertically disposed side walls 13 of the luggage piece or case 10 are provided around three quarters or a similar portion of their periphery with one element of a slide-fastener 37, the retaining flange of which is interposed and heat sealed or otherwise secured between or on one side of the double plies of material that form the walls 13, as shown in FIG. 6 of the drawings.

The outer edges of the horizontally disposed, hinged cover panel 11 are also provided with one element of a slide fastener 37 in the same manner, as clearly shown in FIG. 3 of the drawings, so that when the hinged cover panel 11 is placed in closed position over the access opening of the inflated luggage piece, the separate elements of the slide-fastener 37 will mesh. The clasp of the slide fastener may then be drawn around the peripheral edge of the enclosure to thus secure the contents of the luggage piece therein in a well known manner.

It should be noted by reference to FIGS. 1 and 4, that any one of such vertically disposed conduits 18 or any one of the horizontally disposed air passages 16 could be utilized as the means for inflating the entire system of communicating passages with air under pressure. The air under pressure may be derived from a single source, such as a separate lightweight portable air pump (not shown) commonly used for inflating the bladder of footballs, basketballs and the like gas station air pumps, vacuum cleaners and of course by mouth. This could be easily accomplished by providing one of the conduits 18 or air passages 16 with a short, flexible extension 18' (such as shown in FIG. 4) having a two-way valve member 20 attached thereto to which a short flexible hose from a suitable air pump may be attached.

Figure 8:
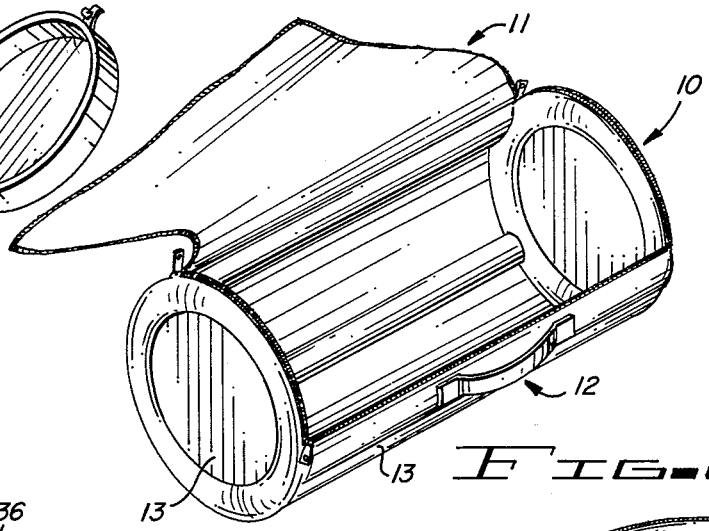
FIG. 8 is a perspective view of a further embodiment of an inflatable luggage piece having a cylindrical form and incorporating the features of this invention.
Figure 9:
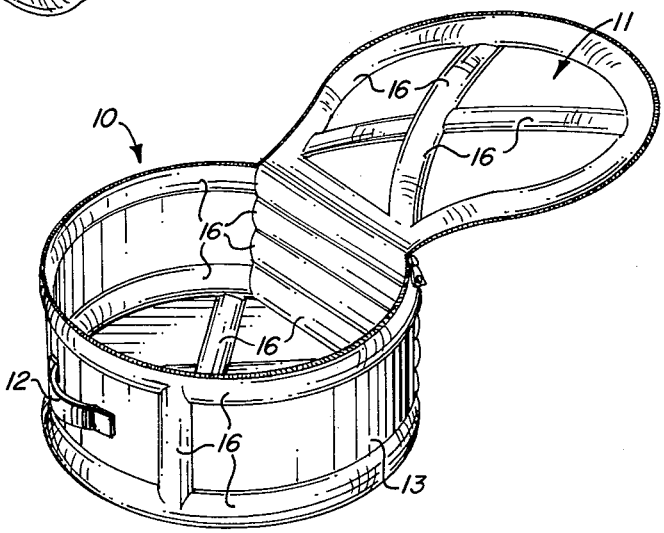
FIG. 9 is a perspective view of a further modification of inflatable luggage pieces shown in FIGS. 1 and 8 having a round or circular form that may be used as a hat box or the like and incorporating the features of this invention.
Figure 10:
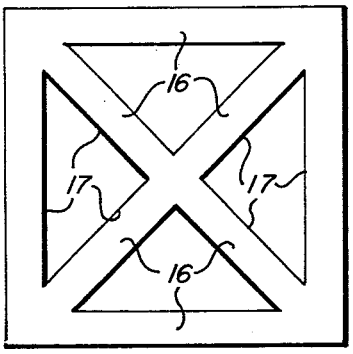
FIGS. 10, 11 and 12 are diagrammatic views illustrating various possible design arrangements of the communicating airchambers and passages in the structural walls or covers of the inflatable luggage.
Figure 11:
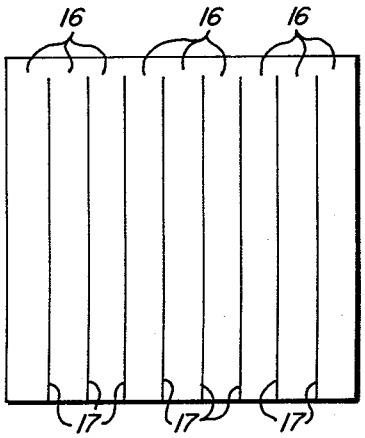
Figure 12:
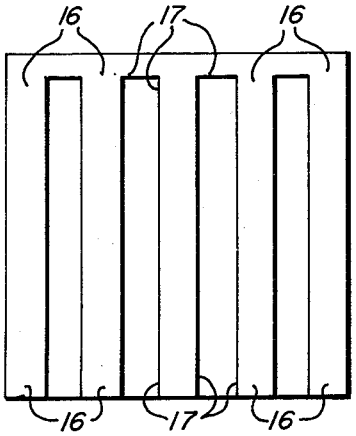

The above described arrangement for inflating the air chambers and communicating passages of the luggage piece may be utilized in luggage having simple, inexpensive carrying handles 12, such as shown in FIGS. 1, 8 and 9 of the drawings. These handles may be fabricated of the same two-ply material used for the structural walls of the luggage and secured in the desired location to the same. Such luggage need separate pump means for inflation purposes, thus creating additional elements which should be available or carried with the luggage. This need presents no particular problem since such a pump means is usually a small, cylindrical type carried in the luggage when the same is rolled up in its deflated collapsed condition for storage purposes.

Figure 5:
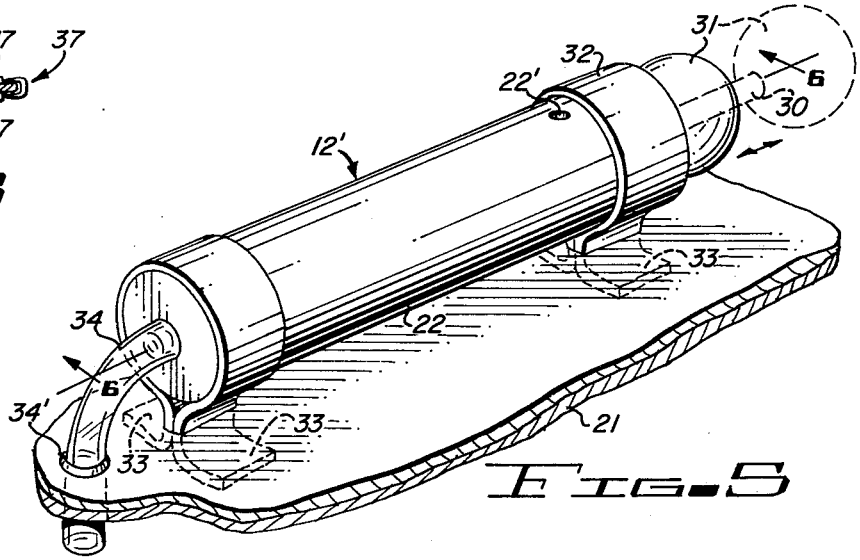
FIG. 5 is a fragmentary perspective view showing a modified version of the luggage handle shown in FIG. 1 illustrating one method of utilizing the handle as an integrated source of air supply for the inflatable luggage.

Should it be desired to combine the functions of the carrying handle 12 and the pump to eliminate the necessity for carrying and storing separately the pump, the carrying handles 12 may be replaced with a modified form of the same which combines the functions of both elements, as clearly shown in FIGS. 5 and 6 of the drawings.

The combined handle-pump 12' is preferably fabricated of lightweight, high tensile strength plastic as is also the narrow, elongated reinforcing plate 21 to which it is attached. It is comprised of a hollow cylindrical body portion 22 having substantially closed ends with longitudinally aligned central apertures 23 and 24 therein. Aperture 23 is arranged in a projecting boss 25 and aperture 24 is provided with a radially extending cutput or notch 26 which extends through the end wall of the cylinder. A vent hole 22' is provided in the body portion 22 for purposes which will become apparent as this description proceeds.

The smooth bore of the hollow cylindrical body portion 22 is fitted with the usual piston 27 in slidable relationship therewith. Piston 27 is provided with a sealing means such as a piston ring on its circular peripheral edge and an aperture 28 extending therethrough. Aperture 28 is adapted to be closed or opened to the passage of air by means of a flap valve 29. Piston 27 is provided with a central shaft 30 that extends through aperture 24 outwardly beyond the end wall of the cylindrical body portion 22 where it is provided with a suitable handle or knob 31 that may be used for manually operating the pump portion of the handle.

The cylindrical body portion 22 of the handle-pump 12' is provided at each end with suitable support brackets 32 having integral depending extensions forming right angled opposed flat surfaced feet 33. These feet are adapted to be secured in rigid relationship to the narrow elongated plate 21, previously described by thermal welding or otherwise. Plate 21 is interposed between the double plies of the wall structure to which the handle-pump is secured and retained in this position by heat sealing. A short flexible hose 34 is connected to boss 25 at one end of the cylindrical body 22 of the handle-pump and allowed to extend through aligned apertures in the outer ply of flexible material forming the luggage and the reinforcing plate 21 into one of the air passages 16. At this point, 34' is sealed from air leakage to thereby provide a means associated with the handle-pump 12' for inflating or deflating the chambers and passages of the luggage piece.

The handle-pump 12' operates in the same manner as any separate pump to inflate the luggage. Thus, the user reciprocates piston 27 in the bore of the cylinder by means of its handle or knob 31 from the position shown in full line in FIG. 6 to the position indicated by dotted line in the same figure. The inward motion of the piston is limited by a projecting abutment 30' on the piston shaft 30. Each full stroke of the piston results in air being drawn into the bore of the cylinder through the vent hole 22' and pumped through the aperture 28 and the open valve 29 in piston 27, aperture 23 in the end wall of the cylinder and the short length of flexible hose 34 into one of the air chambers 16. Continuing this action until all the communicating chambers and passages of the structural walls of the luggage piece are completely filled expands the luggage thus completing the process of manual inflation of the same.

Figure 7:
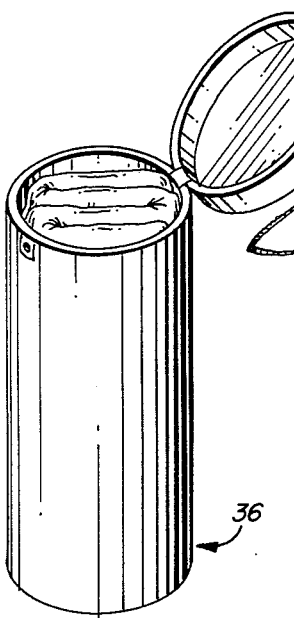
FIG. 7 is a perspective view of a cannister or cylindrical container having a hinged cover and fastening means therefore utilized for packaging the deflated and collapsed luggage pieces for easily carrying and conviently storing it.
Figure 21:
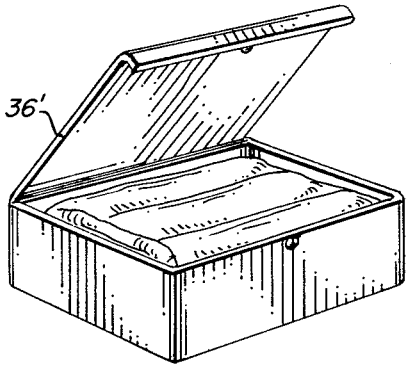
FIG. 21 is a further example of a flat storage container for storing deflected luggage pieces.

To deflate the chambers and passages of the luggage piece, it is only necessary for the user to place piston 27 in the position shown in dotted line in FIG. 6 slightly beyond vent 22' in the bore of portion 22 and retain it in this position by means of the handle knob 31. Pressurized air in the chambers and passages escapes through the short hose 34, aperture 23, the bore of the cylindrical body portion 22 and vent hole 22' to atmosphere. This action results in total collapse of the luggage piece, making it possible to roll or fold it into a small compact article and stored, for example, in a suitable cylindrical container 36 such as shown in FIG. 7 or a flat container 36' shown in FIG. 21.

Retaining the pressurized air in the chambers and passages of the luggage piece in leakproof relationship easily can be accomplished by pushing piston 27 with its shaft 30 further into the bore of the cylinder and causing the projecting abutment 30' on the shaft to pass through the radial cutout or notch 26 in the periphery of aperture 24 at the end of cylinder and rotating the piston and its shaft 180 degrees so that the abutment 30' lodges against the inner end wall of the cylindrical body portion 22, thereby sealing the chamber formed in the bore of the cylinder between the face of the piston and the end wall. The air pressure in the cylinder closes flap valve 29 thus preventing the escape of air from the chambers and passages and maintaining the inflated condition of the luggage piece.

If desired, a separate shut off valve (not shown) arranged between the handle-pump 12' and air chambers 16 of the luggage may be used to seal the air under pressure in chambers 16, thereby avoiding any possible leakage of the air past the piston of the pump.

Further, if so desired the handle-pump 12' may comprise a canister of air under pressure which is releasable into hose 34 for inflating the luggage which is periodically replaced.

Figure 13:
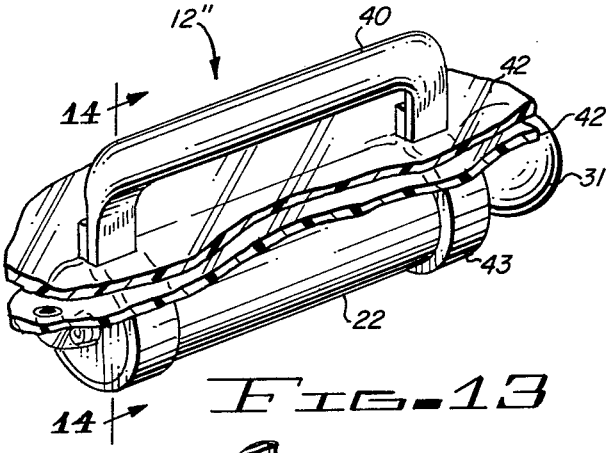
FIG. 13 is a modification of the luggage handle shown in FIGS. 5 and 6 wherein the air pump associated with the handle is mounted inside of the luggage.
Figure 14:
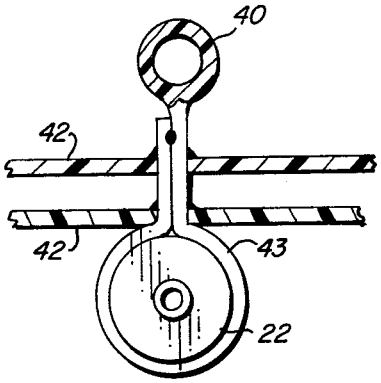
FIG. 14 is a cross-sectional view of FIG. 13 taken along the line 14—14.

FIGS. 13 and 14 illustrate a modification of the integrated luggage handle and pump means shown in FIG. 5 and 6 wherein the handle pump combination 12" comprises a handle member 40 extending outwardly of the walls 42 of the luggage which handle may have integrated flanges 43 for surrounding the cylinder 22 of the pump structure shown in FIGS. 5 and 6. With the pump structure inside of the luggage, it is free from meddling and protected from damage when the luggage is handled or shipped.

FIGS. 8 and 9 are intended to illustrate examples of other forms of luggage using the inflatable features of this invention in various luggage piece configurations.

Figure 19:
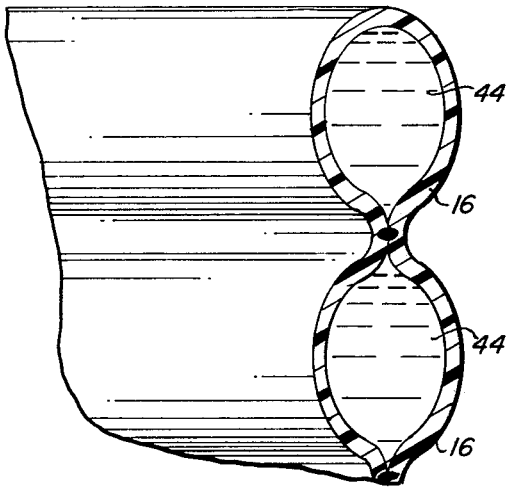
FIG. 19 is an illustration of inflatable passageways of luggage pieces of the subject disclosure which are filled with a suitable liquid.
Figure 20:
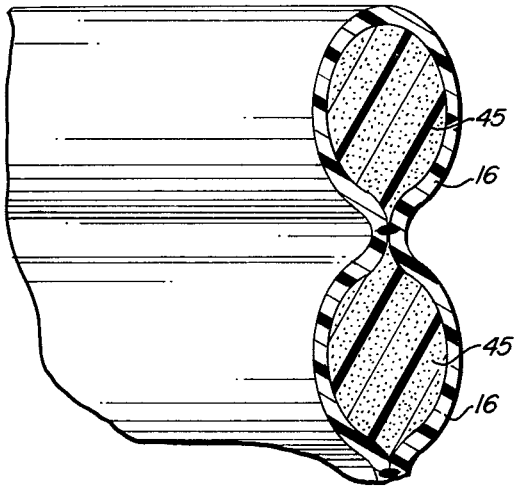
FIG. 20 is an illustration of inflatable passageways of luggage pieces of the subject disclosure which are filled with a suitable plastic foam like material.

It should be recognized that the inventive concepts disclosed herein may be employed to package, store and ship delicate scientific materials and liquids, package and transport valuable art items, opera sets, paintings, statues — large and small. With this in mind, it should be noted that the passages 16 of the luggage may be filled with a substance other than air, such as any suitable liquid 44 as shown in FIG. 19 or a suitable plastic foam material 45 as shown in FIG. 20. If a setting plastic is used for inflating the luggage, the luggage could be stored until needed in its collapsed condition and then permanently inflated when used.

Figure 15:
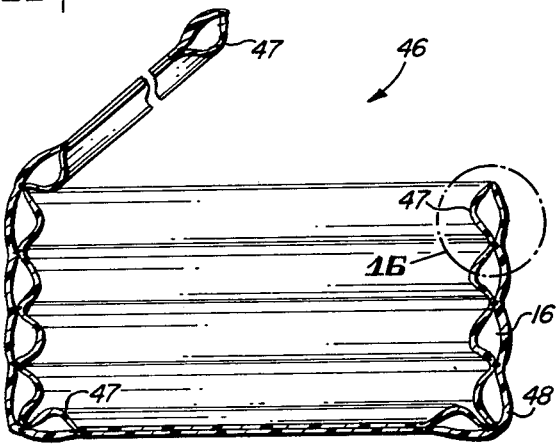
FIG. 15 is a modification of the inflatable luggage piece shown in FIGS. 1, 2 and 9–12 wherein the walls of the inflatable passageways are formed of different thickness or materials of different resiliency causing the passageways when inflated to expand into non-circular cross-sectional configurations.
Figure 16:
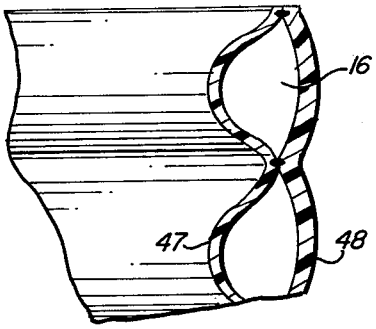
FIG. 16 is a fragmentary elevational view indicated by the circle "16" in FIG. 15 showing a right angle corner of the luggage piece.

FIGS. 15 and 16 illustrate a further modification of the luggage and its features shown in FIGS. 1–14 wherein the luggage piece 46 is shown as comprising an inner layer 47 of a one ply of material and an outer layer 48 of two plies of material. With this form of construction, most of the expansion of the passages 16 of the luggage piece is internal of the piece where it can give under the protective shield of the outer layer to protect the enclosed luggage.

Figure 18:
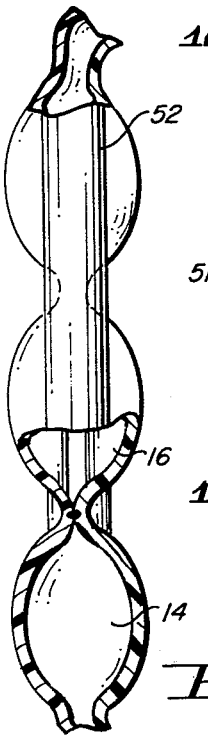
FIG. 18 is a cross-sectional view of FIG. 17 taken along the line 18—18.
Figure 17:
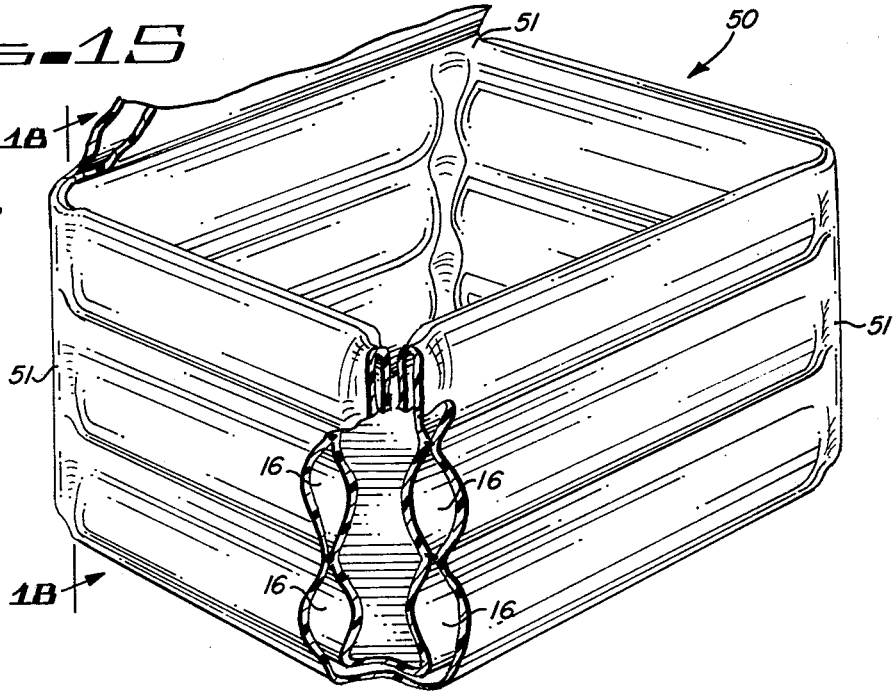
FIG. 17 is a partial perspective view of a further modification of the luggage pieces shown in FIGS. 1, 9 and 15 wherein the juxtapositioned inflatable passageways are in direct communication with each other at the corners of the luggage piece.

FIGS. 17 and 18 illustrate a further luggage piece 50 capable of having the same benefits of the previous luggage pieces disclosed herein but illustrating that the corners 51 of the luggage piece are formed to provide interconnecting means 52 between juxtapositioned passages 16 without the need of conduit 18 shown in FIG. 4. These interconnecting means are merely spaces between the plies of material forming the luggage piece at the corners interconnecting juxtapositioned passages 16 as shown.

By utilizing this form of construction, the luggage piece may be collapsed and rolled or folded for storage rather than a structure using conduit 18.

It should be noted that one or more of the sides, bottom, ends and cover of the luggage pieces may be inflatable with many different types of design configurations of the passages used. FIGS. 8–12 show a few possible arrangements of the inflatable passageways.

Although but a few embodiments of the present invention have been illustrated and described, it will be obvious to one skilled in the art that various changes may be made in the structure shown without departing from the spirit of the claimed invention.

I claim:

1. Inflatable and collapsible luggage comprising:

a case having walls which define a storage compartment having a closeable opening, the walls of said case being formed at least in part from a fluid impervious material and define a plurality of tubular interconnected passages, handle means secured to said case, a conduit connected to one of said passages for receiving air to inflate said passages and render said case rigid and self supporting, said passages when inflated extending outwardly of said case to form a plurality of spaced ribs arranged in a ribbed configuration for protecting the case and its contents, said case when deflated collapsing so that it can be folded or coiled for storage purposes, said handle means comprising means connected to said conduit for inflation and deflation of said passages.

2. The inflatable and collapsible luggage set forth in claim 1 wherein:

said means for inflation and deflation is positioned inside of said case.

3. The inflatable and collapsible luggage set forth in claim 1 wherein:

said means for inflation and deflation is positioned outside of said case.

4. The inflatable and collapsible luggage set forth in claim 1 wherein:

said means for inflating and deflating said passages comprises an air pump.

5. The inflatable and collapsible luggage set forth in claim 1, wherein:

said passages are defined by walls formed of pliable material of different expansion characteristics.

6. The inflatable and collapsible luggage set forth in claim 1 wherein:

said walls of said passages arranged on the inside of said storage compartment expand to a greater extent than the walls of said passages arranged on the outside of said storage compartment, whereby said walls of said passages on the outside of said case provide a smoother appearance than the walls on the inside of said case.

* * * * *